US008783681B2

(12) United States Patent
Hsu

(10) Patent No.: US 8,783,681 B2
(45) Date of Patent: Jul. 22, 2014

(54) PAPER-PRESSING TRAY MOUNTING APPARATUS FOR PRINTING APPARATUS

(71) Applicant: Hon Hai Precision Industry Co., Ltd., New Taipei (TW)

(72) Inventor: Wen-Hsien Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/895,363

(22) Filed: May 16, 2013

(65) Prior Publication Data

US 2013/0341853 A1 Dec. 26, 2013

(30) Foreign Application Priority Data

Jun. 21, 2012 (TW) ..... 101122246

(51) Int. Cl.
*B65H 31/04* (2006.01)
*B65H 1/00* (2006.01)

(52) U.S. Cl.
USPC ..... 271/213; 271/162; 271/145; 271/207

(58) Field of Classification Search
USPC ..... 271/145, 162, 279, 207, 213
See application file for complete search history.

(56) References Cited

U.S. PATENT DOCUMENTS

| | | | | |
|---|---|---|---|---|
| 5,287,164 | A * | 2/1994 | Watanabe | 399/391 |
| 6,776,405 | B2 * | 8/2004 | Eskey | 271/9.08 |
| 7,448,617 | B2 * | 11/2008 | Fujioka et al. | 271/207 |
| 8,602,412 | B2 * | 12/2013 | Ma | 271/207 |
| 8,641,032 | B2 * | 2/2014 | Nakamura et al. | 271/9.05 |
| 2005/0206070 | A1 * | 9/2005 | Connors et al. | 271/145 |
| 2006/0244203 | A1 * | 11/2006 | Kirby et al. | 271/162 |
| 2008/0128975 | A1 * | 6/2008 | Sosnowski et al. | 271/162 |
| 2008/0296831 | A1 * | 12/2008 | Chino | 271/145 |
| 2010/0066006 | A1 * | 3/2010 | Wong et al. | 271/3.18 |
| 2010/0164169 | A1 * | 7/2010 | Wakakusa | 271/127 |
| 2012/0080834 | A1 * | 4/2012 | Shiohara et al. | 271/9.04 |
| 2013/0009360 | A1 * | 1/2013 | Ma | 271/279 |

* cited by examiner

*Primary Examiner* — Patrick Cicchino
(74) *Attorney, Agent, or Firm* — Novak Druce Connolly Bove + Quigg LLP

(57) ABSTRACT

A paper-pressing tray mounting apparatus for a printing apparatus includes a first paper support tray, a second paper support tray mounted on the first paper support tray, a paper-pressing tray pivotally mounted on the second paper support tray, and a sliding panel mounted on the second paper support tray. When the second paper support tray moves toward the first paper support tray along a first direction, the sliding panel moves on the second paper support tray along a second direction opposite to the first direction, the sliding panel abuts against the paper-pressing tray, the paper-pressing tray rotates toward the first paper support tray around the second paper support tray, the second paper support tray is accommodated in the first paper support tray, and the paper-pressing tray is accommodated between the first paper support tray and the second paper support tray.

17 Claims, 5 Drawing Sheets

PAPER-PRESSING TRAY MOUNTING APPARATUS FOR PRINTING APPARATUS

BACKGROUND

1. Technical Field

The present disclosure relates to a paper-pressing tray mounting apparatus for a printing apparatus.

2. Description of Related Art

A printing apparatus, such as a printer or a photocopying machine, feeds a sheet of paper from an input tray, prints an image on the paper, and discharges the printed paper to one of the several output trays according to the size of the printed paper. In most office environments, a single printing apparatus is used by a number of users. A large number of paper sheets are laid on different output trays of the printing apparatus. A paper-pressing tray is mounted on the printing apparatus to stop the printed papers on the output trays. The paper-pressing tray is opened when the output trays are pulled out. However, the paper-pressing tray cannot be closed when the output trays are pushed back. The paper-pressing tray interferes with the output trays, and the printing apparatus malfunctions.

Therefore, it is desirable to provide a paper-pressing tray that can overcome the above-mentioned problems.

DETAILED DESCRIPTION

Embodiments of the present disclosure will be described with reference to the drawings.

Figure 1:
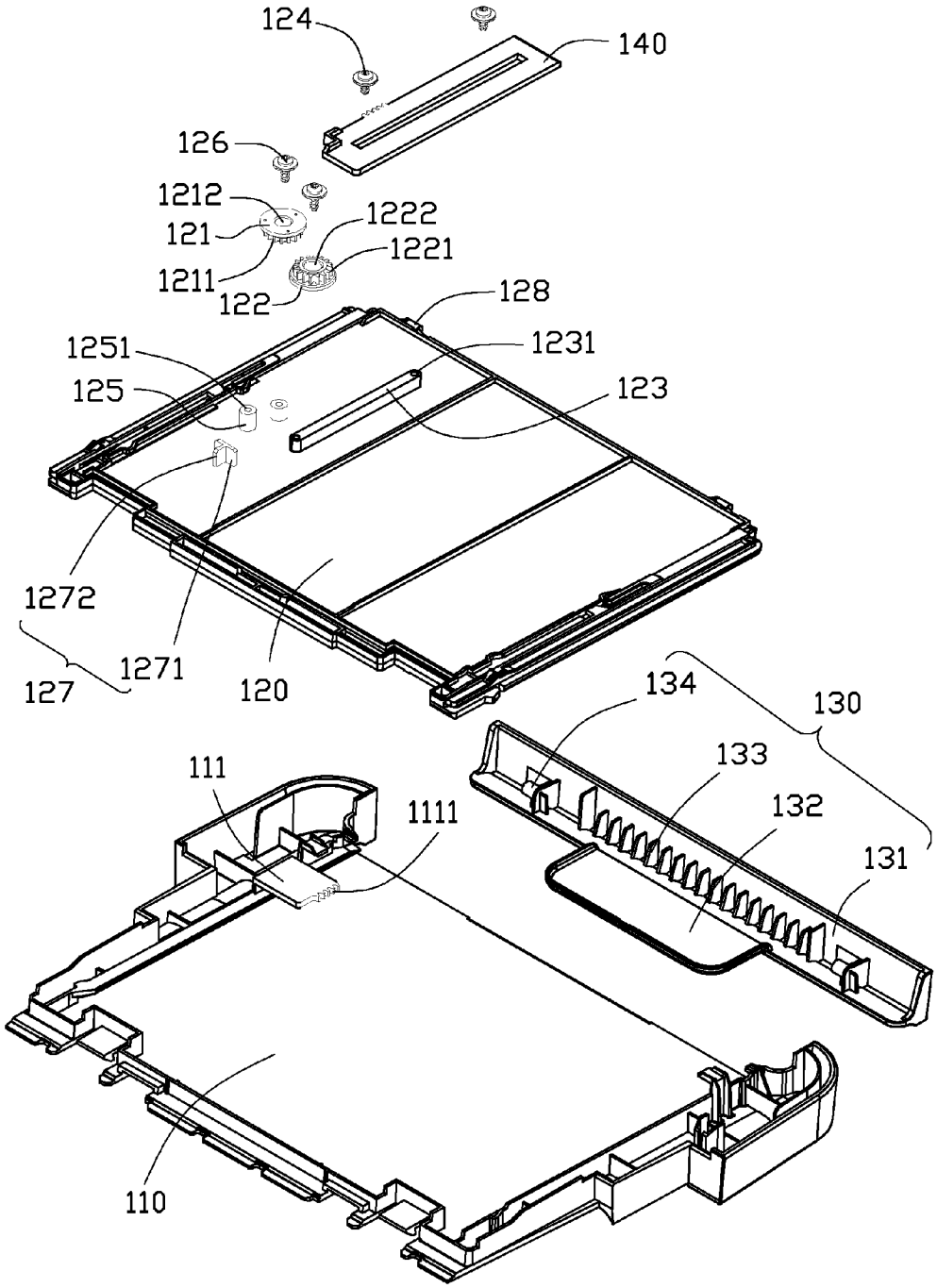
FIG. 1 is an exploded view of one embodiment of a paper-pressing tray mounting apparatus for a printing apparatus; the paper-pressing tray mounting apparatus for a printing apparatus comprises a first paper support tray, a second paper support tray, a paper-pressing tray, and a sliding panel.
Figure 2:
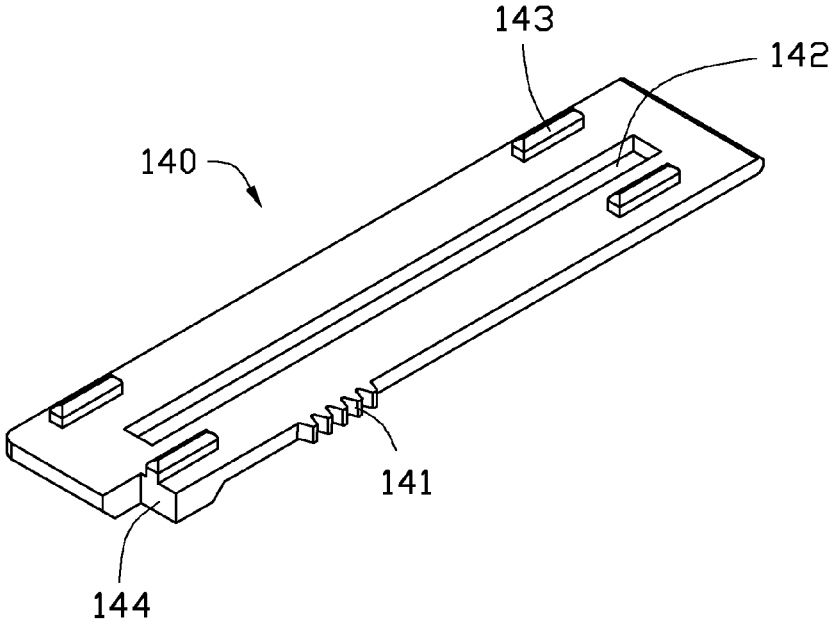
FIG. 2 is an isometric view of the sliding panel of FIG. 1.

FIGS. 1 and 2 show a paper-pressing tray mounting apparatus for printing apparatuses and supports a plurality of papers (not shown). The paper-pressing tray mounting apparatus includes a first paper support tray 110, a second paper support tray 120 mounted on the first paper support tray 110, a paper-pressing tray 130 pivotally mounted on the second paper support tray 120, and a sliding panel 140 slidably mounted on the second paper support tray 120. A stack of paper can be positioned on the first paper support tray 110 and the second paper support tray 120.

A protrusion block 111 is on the first paper support tray 110 adjacent to the paper-pressing tray 130. The protrusion block 111 includes a plurality of first racks 1111. A first gear 121 and a second gear 122 are mounted on the second paper support tray 120. The first gear 121 includes a plurality of first teeth 1211 corresponding to the plurality of first racks 1111. The second gear 122 includes a plurality of second teeth 1211 corresponding to the plurality of first teeth 1211. The sliding panel 140 includes a plurality of second racks 141 corresponding to the plurality of second teeth 1221. A rod-shaped sliding slot 142 can be defined on the sliding panel 140. The sliding panel 140 includes a plurality of supporting legs 143 on a side of the top panel 140. The second paper support tray 120 includes a rod-shaped protrusion bar 123. Two first mounting holes 1231 are defined on the protrusion bar 123. The protrusion bar 123 is accommodated in the sliding slot 142. Two first fastening members 124 pass though the corresponding two first mounting holes 1231 to fix the sliding panel 140 on the second paper support tray 120. The plurality of supporting legs 143 abuts against a top surface of the second paper support tray 120.

The second paper support tray 120 includes two protrusion poles 125 corresponding to the first gear 121 and the second gear 122. A second mounting hole 1251 is defined on each of the two protrusion poles 125. A first through hole 1212 is defined on the first gear 121. A second through hole 1222 is defined on the second gear 122. The two protrusion poles 125 pass though the corresponding first through hole 1212 and the second through hole 1222. Two second fastening members 126 pass though the corresponding second mounting holes 1251 to fix the first gear 121 and the second gear 122 on the second paper support tray 120. The second paper support tray 120 includes a stop portion 127 adjacent to the two protrusion poles 125. The stop portion 127 includes a resisting wall 1271 extended upwards from the second paper support tray 120 and a supporting wall 1272 connected to the resisting wall 1271. In one embodiment, the resisting wall 1271 is substantially perpendicular to the second paper support tray 120, and the supporting wall 1272 is substantially perpendicular to the resisting wall 1271. A notch 144 is defined in the sliding panel 140 corresponding to the resisting wall 1271.

The paper-pressing tray 130 includes a connection portion 131, a resisting portion 132 extended from the connection portion 131, a plurality of resisting slices 133 extending substantially perpendicularly from the connection portion 131, and two circular pivoting axis 134 beside the plurality of resisting slices 133. Two column-shaped pivoting portions 128 are on the second paper support tray 120 corresponding to the pivoting axis 134. The two pivoting portions 128 engage with the corresponding pivoting axis 134 to fix the paper-pressing tray 130 onto the second paper support tray 120. In one embodiment, a length of the connection portion 131 is greater than that of the resisting portion 132. In an original state, the second paper support tray 120 is accommodated in the first paper support tray 110. The resisting portion 132 of the paper-pressing tray 130 is accommodated between the first paper support tray 110 and the second paper support tray 120.

Figure 3:
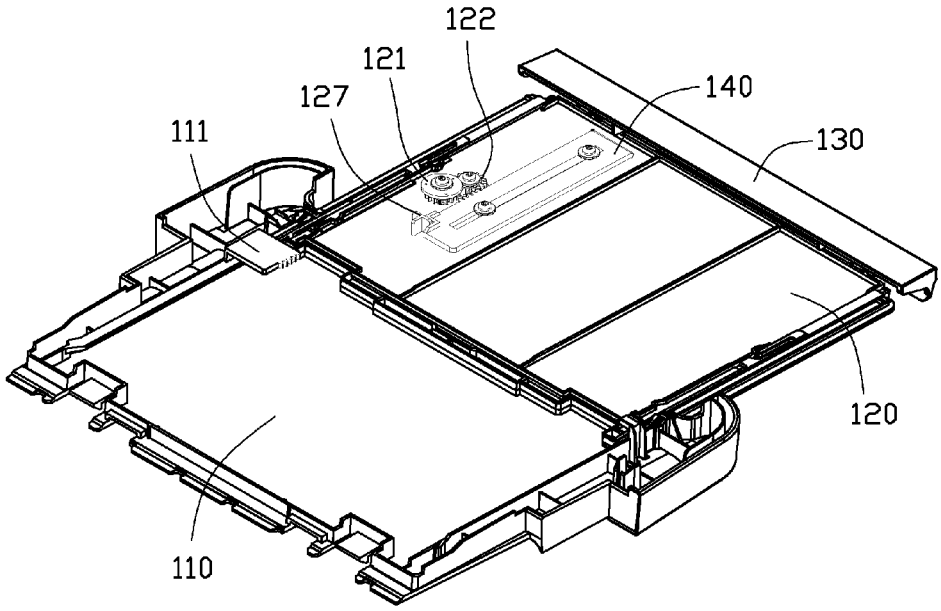
FIG. 3 is an assembled view of the paper-pressing tray mounting apparatus of FIG. 1 in one state.
Figure 4:
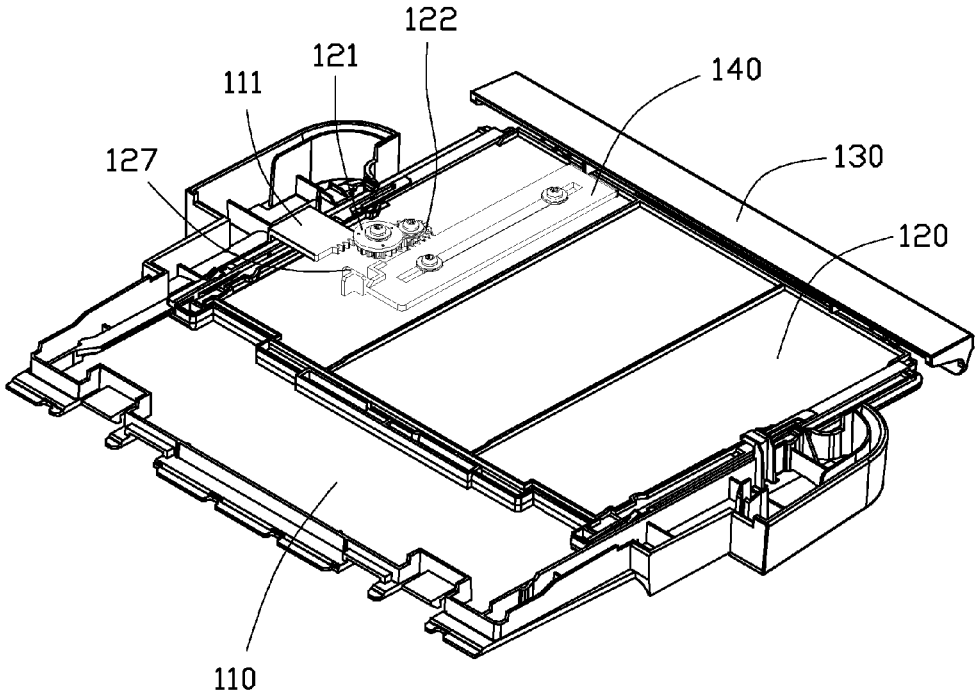
FIG. 4 is an assembled view the paper-pressing tray mounting apparatus of FIG. 1 in another state.
Figure 5:
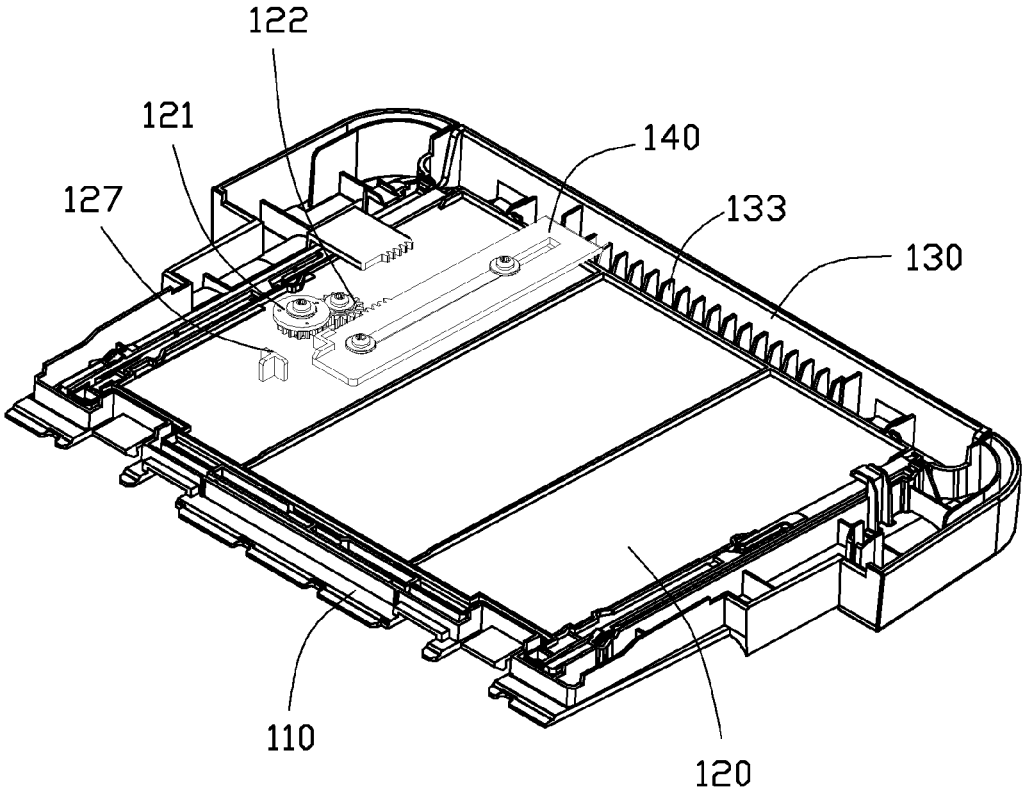
FIG. 5 is an assembled view the paper-pressing tray mounting apparatus of FIG. 1 in yet another state.

FIGS. 3 and 5 show that in working state, when the second paper support tray 120 moves away from the first paper support tray 110 along a second direction, the plurality of first racks 1111 on the protrusion block 111 engage with the plurality of first teeth 1211 on the first gear 121. The protrusion block 111 drives the first gear 121 rotating along a fourth direction. The plurality of first teeth 1211 on the first gear 121 engage with the plurality of second teeth 1221 on the second gear 122. The first gear 121 drives the second gear 122 to rotate along a third direction opposite to the fourth direction. The plurality of second teeth 1221 on the second gear 122 engage with the plurality of second racks 141 on the sliding panel 140. The second gear 122 drives the sliding panel 140 to slide on the second paper support tray 120 along a first direction opposite to the second direction. The second paper support tray 120 is pulled out from the first paper support tray 110. When the second paper support tray 120 is pulled to a limited position, the notch 144 in the sliding panel 140 resists against the resisting wall 1271 on the stop portion 127 to protect the second paper support tray 120 from being separated from the first paper support tray 110. The connection portion 131 of the paper-pressing tray 130 is rotated to release the resisting portion 132 from between the first paper support tray 110 and the second paper support tray 120.

When the second paper support tray 120 moves toward the first paper support tray 110 along the first direction, the plurality of first racks 1111 on the protrusion block 111 engage with the plurality of first teeth 1211 on the first gear 121. The protrusion block 111 drives the first gear 121 to rotate along the third direction. The plurality of first teeth 1211 on the first gear 121 engage with the plurality of second teeth 1221 on the second gear 122. The first gear 121 drives the second gear 122 to rotate along the fourth direction. The plurality of second teeth 1221 on the second gear 122 engage with the plurality of second racks 141 on the sliding panel 140. The second gear 122 drives the sliding panel 140 to slide on the second paper support tray 120 along the second direction. The sliding panel 140 abuts against the paper-pressing tray 130 via the plurality of resisting slices 133. The paper-pressing tray 130 rotates toward the first paper support tray 110 around the second paper support tray 120. The resisting portion 132 of the paper-pressing tray 130 is accommodated between the first paper support tray 110 and the second paper support tray 120 again. The second paper support tray 120 is pushed back and is accommodated in the first paper support tray 110 again. In one embodiment, the third direction is a clockwise direction, and the fourth direction is a counterclockwise direction.

Even though numerous characteristics and advantages of the present disclosure have been set forth in the foregoing description, together with details of the structure and function of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A paper-pressing tray mounting apparatus for a printing apparatus comprising:

a first paper support tray;

a second paper support tray mounted on the first paper support tray;

a paper-pressing tray pivotally mounted on the second paper support tray; and a sliding panel slidably mounted on the second paper support tray; wherein when the second paper support tray moves toward the first paper support tray along a first direction, the sliding panel slides on the second paper support tray along a second direction opposite to the first direction, the sliding panel abuts against the paper-pressing tray, the paper-pressing tray rotates toward the first paper support tray around the second paper support tray, the second paper support tray is accommodated in the first paper support tray, and the paper-pressing tray is accommodated between the first paper support tray and the second paper support tray.

2. The paper-pressing tray mounting apparatus of claim 1, further comprising a protrusion block on the first paper support tray, a plurality of first racks on the protrusion block, and a first gear and a second gear mounted on the second paper support tray; the first gear comprises a plurality of first teeth corresponding to the plurality of racks, the second gear comprises a plurality of second teeth corresponding to the plurality of first teeth; the sliding panel comprises a plurality of second racks corresponding to the plurality of second teeth; and the protrusion block moves the sliding panel on the second paper support tray via the first gear and the second gear.

3. The paper-pressing tray mounting apparatus of claim 2, wherein when the second paper support tray moves toward the first paper support tray along the first direction, the plurality of first racks on the protrusion block engage with the plurality of first teeth on the first gear, the protrusion block drives the first gear rotating along a third direction, the plurality of first teeth on the first gear engage with the plurality of second teeth on the second gear, the first gear drives the second gear rotating along a fourth direction opposite to the third direction, the plurality of second teeth on the second gear engage with the plurality of second racks on the sliding panel, and the second gear moves the sliding panel on the second paper support tray along the second direction.

4. The paper-pressing tray mounting apparatus of claim 3, further comprising a sliding slot on the sliding panel; the second paper support tray comprises a protrusion bar corresponding to the sliding slot; the protrusion bar comprises two first mounting holes; the protrusion bar is accommodated in the sliding slot; and two first fastening members pass though the corresponding two first mounting holes to fix the sliding panel onto the second paper support tray.

5. The paper-pressing tray mounting apparatus of claim 4, wherein the sliding panel comprises a first side and a plurality of supporting legs on the first side of the sliding panel; and the plurality of supporting legs abuts against a top surface of the second paper support tray when the sliding panel is mounted on the second paper support tray.

6. The paper-pressing tray mounting apparatus of claim 4, wherein the second paper support tray comprises two protrusion poles corresponding to the first gear and the second gear; each of the two protrusion poles comprises a second mounting hole; the first gear comprises a first through hole; the second gear comprises a second through hole; the two protrusion poles pass though the corresponding first through hole and the second through hole; and two second fastening members pass though the corresponding second mounting holes to fix the first gear and the second gear onto the second paper support tray.

7. The paper-pressing tray mounting apparatus of claim 6, further comprising a stop portion on the second paper support tray; the stop portion comprises a resisting wall extended upwards from the second paper support tray and a supporting wall connected to the resisting wall; the sliding panel comprises a notch corresponding to the resisting wall; when the second paper support tray moves away from the first paper support tray along the second direction, the sliding panel slides on the second paper support tray along the first direction, and the notch in the sliding panel resists against the resisting wall on the stop portion.

8. The paper-pressing tray mounting apparatus of claim 1, wherein the paper-pressing tray comprises a connection portion and a resisting portion extended from the connection portion; a plurality of resisting slices extending substantially perpendicularly from the connection portion; the sliding panel abuts against the paper-pressing tray via the plurality of resisting slices; and the resisting portion of the paper-pressing tray is accommodated between the first paper support tray and the second paper support tray when the second paper support tray is accommodated in the first paper support tray.

9. The paper-pressing tray mounting apparatus of claim 8, wherein a length of the connection portion can be greater than that of the resisting portion.

10. A paper-pressing tray mounting apparatus for a printing apparatus comprising:

a first paper support tray;

a second paper support tray mounted on the first paper support tray;

a paper-pressing tray pivotally mounted on the second paper support tray; the paper-pressing tray comprises a connection portion and a resisting portion extended from the connection portion; a plurality of resisting slices extending substantially perpendicularly from the connection portion; and a sliding panel mounted on the second paper support tray; wherein when the second paper support tray moves toward the first paper support tray along a first direction, the sliding panel moves on the second paper support tray along a second direction opposite to the first direction, the sliding panel abuts against the paper-pressing tray, the paper-pressing tray rotates toward the first paper support tray around the second paper support tray, the second paper support tray is accommodated in the first paper support tray, the paper-pressing tray is accommodated between the first paper support tray and the second paper support tray, the sliding panel abuts against the paper-pressing tray via the plurality of resisting slices, the second paper support tray is accommodated in the first paper support tray, and the resisting portion of the paper-pressing tray is accommodated between the first paper support tray and the second paper support tray.

11. The paper-pressing tray mounting apparatus of claim 10, further comprising a protrusion block on the first paper support tray, a plurality of first racks on the protrusion block, and a first gear and a second gear on the second paper support tray; the first gear comprises a plurality of first teeth corresponding to the plurality of racks; the second gear comprises a plurality of second teeth corresponding to the plurality of first teeth; the sliding panel comprises a plurality of second racks corresponding to the plurality of second teeth; and the protrusion block moves the sliding panel on the second paper support tray via the first gear and the second gear.

12. The paper-pressing tray mounting apparatus of claim 11, wherein when the second paper support tray moves toward the first paper support tray along the first direction, the plurality of first racks on the protrusion block engage with the plurality of first teeth on the first gear, the protrusion block drives the first gear rotating along a third direction, the plurality of first teeth on the first gear engage with the plurality of second teeth on the second gear, the first gear drives the second gear rotating along a fourth direction opposite to the third direction, the plurality of second teeth on the second gear engage with the plurality of second racks on the sliding panel, and the second gear moves the sliding panel on the second paper support tray along the second direction.

13. The paper-pressing tray mounting apparatus of claim 12, further comprising a sliding slot on the sliding panel; the second paper support tray comprises a protrusion bar corresponding to the sliding slot; the protrusion bar comprises two first mounting holes; the protrusion bar is accommodated in the sliding slot; and two first fastening members pass though the corresponding two first mounting holes to fix the sliding panel onto the second paper support tray.

14. The paper-pressing tray mounting apparatus of claim 13, wherein the sliding panel comprises a plurality of supporting legs on the first side of the sliding panel; and the plurality of supporting legs abuts against a top surface of the second paper support tray when the sliding panel is mounted on the second paper support tray.

15. The paper-pressing tray mounting apparatus of claim 13, wherein the second paper support tray comprises two protrusion poles corresponding to the first gear and the second gear; each of the two protrusion poles comprises a second mounting hole; the first gear comprises a first through hole; the second gear comprises a second through hole; the two protrusion poles pass though the corresponding first through hole and the second through hole; and two second fastening members pass though the corresponding second mounting holes to fix the first gear and the second gear onto the second paper support tray.

16. The paper-pressing tray mounting apparatus of claim 15, further comprising a stop portion on the second paper support tray; the stop portion comprises a resisting wall extended upwards from the second paper support tray and a supporting wall connected to the resisting wall; the sliding panel comprises a notch corresponding to the resisting wall; when the second paper support tray moves away from the first paper support tray along the second direction, the sliding panel moves on the second paper support tray along the first direction, and the notch in the sliding panel resists against the resisting wall on the stop portion.

17. The paper-pressing tray mounting apparatus of claim 10, wherein a length of the connection portion is greater than that of the resisting portion.

* * * * *